US005472931A

United States Patent [19]

Morohoshi et al.

[11] Patent Number: 5,472,931

[45] Date of Patent: Dec. 5, 1995

[54] IMAGE RECEIVING MEDIUM FOR USE IN SUBLIMATION-TYPE THERMAL IMAGE TRANSFER RECORDING SYSTEM

[75] Inventors: Naoya Morohoshi; Hiroyuki Uemura; Hidehiro Mochizuki, all of Numazu; Masaru Shimada, Shizuoka, all of Japan

[73] Assignee: Ricoh Company, Ltd., Tokyo, Japan

[21] Appl. No.: 575,573

[22] Filed: Aug. 31, 1990

[30] Foreign Application Priority Data

Sep. 1, 1989 [JP] Japan ..... 1-224498

[51] Int. Cl.[6] ..... B41M 5/26; B41M 5/035

[52] U.S. Cl. ..... 503/227; 428/195; 428/447; 428/913; 428/914

[58] Field of Search ..... 428/195, 200, 428/411.1, 446, 447, 913, 914; 503/227

[56] References Cited

U.S. PATENT DOCUMENTS 4,626,256 12/1986 Kawasaki et al. ..... 8/471

*Primary Examiner*—Patrick J. Ryan
*Assistant Examiner*—Elizabeth Evans
*Attorney, Agent, or Firm*—Oblon, Spivak, McClelland, Maier, & Neustadt

[57] ABSTRACT

An image receiving medium for use in a sublimation-type thermal image transfer recording system, comprising a substrate, and a dye receiving layer formed thereon, comprising (a) a resin which can be dyed with a heat-sublimable dye, such as a copolymer of vinyl chloride and vinyl acetate, (b) a first silicone oil which is compatible with the resin, such as polyether-modified silicone oil, and (c) a second silicone oil which is not compatible with the resin, such as amino-modified silicone oil.

10 Claims, 2 Drawing Sheets

IMAGE RECEIVING MEDIUM FOR USE IN SUBLIMATION-TYPE THERMAL IMAGE TRANSFER RECORDING SYSTEM

BACKGROUND OF THE INVENTION

1. Field of the Invention

This invention relates to an improved image receiving medium for use in combination with a thermal image transfer recording medium in a sublimation-type thermal image transfer recording system.

2. Discussion of Background

A sublimation-type thermal image transfer recording system is characterized by employing a thermal image transfer recording medium which comprises a dye transfer layer containing a heat-sublimable dye, and an image receiving medium capable of receiving the dye which is sublimed when the thermal image transfer recording medium is superimposed on the image receiving medium and heated from the back side thereof. Since the above recording system can produce a full-colored hard copy with an excellent half tone, comparable to a color photograph, it is greatly attracting public attention now.

A thermoplastic resin which can be readily dyed with a heat-sublimable dye, such as a polyester resin, has been used for a dye receiving layer of the conventional image receiving medium for use in the sublimation-type thermal image transfer recording system. The thermoplastic resin, however, has a low thermal resistance, so that the image receiving medium readily fuses when thermal recording is conducted, and sticks to a thermal image transfer recording medium (color sheet). As a result, the image receiving medium cannot be easily released from the thermal image transfer recording medium after the recording.

In order to solve the above problem, a releasant such as a silicone oil has been incorporated into a dye receiving layer of the image receiving medium.

In the case where a silicone oil is incorporated into the dye receiving layer, the image transfer recording medium can easily be released from the image receiving medium after thermal recording. The degree of ease of the release becomes high as the amount of the silicone oil incorporated increases. The use of a large amount of silicone oil, however, decreases the adhesion between a substrate and the dye receiving layer formed thereon. As a result, the dye receiving layer is peeled off the substrate and is transferred to the image transfer recording medium after thermal recording. In addition, the use of a large amount of silicone oil makes the surface of the dye receiving layer excessively slippery, so that the image receiving medium cannot normally move on the image transfer recording medium.

SUMMARY OF THE INVENTION

Accordingly, it is an object of the present invention to provide an image receiving medium for use in combination with a thermal image transfer recording medium in a sublimation-type thermal image transfer recording system, which can be readily released from the thermal image transfer recording medium after thermal recording, and yet the adhesion between a substrate thereof and a dye receiving layer formed thereon is sufficiently high.

The above object of the present invention can be attained by an image receiving medium comprising a substrate, and a dye receiving layer formed thereon, comprising (a) a resin which can be dyed with a heat-sublimable dye, (b) a first silicone oil which is compatible with the resin and (c) a second silicone oil which is not compatible with the resin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
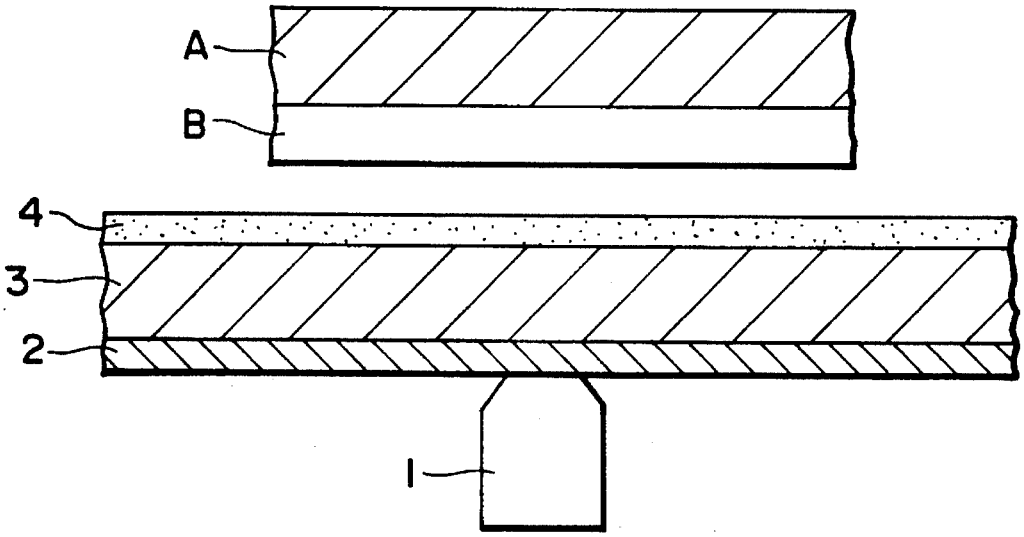
FIG. 1 is a schematic cross-sectional view of an image receiving medium according to the present invention and a thermal image transfer recording medium for use in a sublimation-type thermal image transfer recording system.

The important feature of the image receiving medium of the present invention is that a dye receiving layer formed on a substrate comprises (a) a resin which can be dyed with a heat-sublimable dye, (b) a first silicone oil which is compatible with the resin, and (c) a second silicone oil which is not compatible with the resin.

Thus, in the present invention, since the first and second silicone oils are used in combination in the dye receiving layer, the adhesion between the substrate and the dye receiving layer is enhanced, and an improvement is made on the image receiving medium so that it can be easily released from an image transfer recording medium. Moreover, since the amount of the silicone oil contained in the vicinity of the surface of the dye receiving layer is small, the image receiving medium is prevented from slipping when moving on the thermal image transfer recording medium, and proper movement is ensured. Furthermore, even when the image receiving media are preserved in piles, the silicone oil contained in the dye receiving layer scarcely transfers to the other image receiving medium directly placed on the dye receiving layer.

Referring now to the accompanying drawings, wherein like reference numerals designate identical or corresponding parts throughout the several views, the present invention will be explained in more detail.

As shown in FIG. 1, an image receiving medium of the present invention comprises a substrate A and a dye receiving layer B formed thereon. More specifically, the dye receiving layer B comprises (a) a resin which can be dyed with a heat-sublimable dye and (b) the first and second silicone oils is formed on the substrate A.

In this figure, reference numeral 1 designates a thermal head, and reference numerals 2, 3 and 4 respectively designate a heat resistive layer, a substrate and a dye transfer layer of a thermal image transfer recording medium which is used in combination with the image receiving medium.

When the image receiving medium is superimposed on the thermal transfer recording medium and heat is applied from the thermal head 1, a heat-sublimable dye contained in the dye transfer layer 4 of the thermal image transfer recording medium sublimes and diffuses therein, and is then transferred to the dye receiving layer B of the image receiving medium. The transferred dye diffuses in the dye receiving layer B to dye the resin contained therein.

Figure 2:
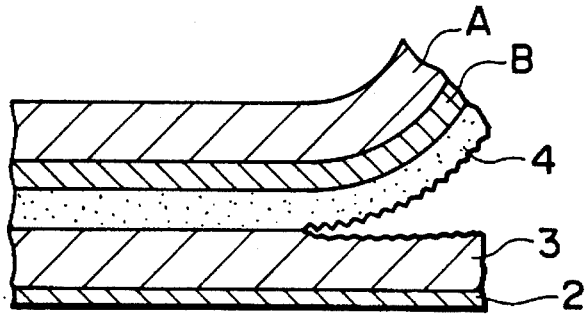
FIG. 2 is a schematic illustration of the improper peeling of a conventional image receiving medium off a dye transfer layer of a thermal image transfer recording medium after thermal recording.

As mentioned previously, it has been conventionally known that a releasant such as a silicone oil is incorporated into the dye receiving layer B of the image receiving medium. In this case, when the amount of the releasant is small, the dye receiving layer B cannot be smoothly released from the dye transfer layer 4 of the thermal image transfer recording medium after thermal recording, and the dye transfer layer 4 itself is peeled off the substrate 3 and transferred to the dye receiving layer B as illustrated in FIG. 2.

Figure 3:
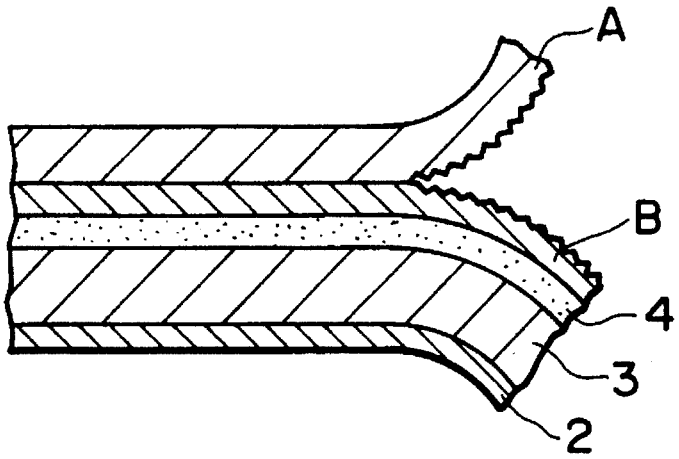
FIG. 3 is a schematic illustration of the improper adhesion of a dye receiving layer of the conventional image receiving medium to a substrate thereof after thermal recording.

On the other hand, when a large amount of the releasant is incorporated into the dye receiving layer B in order to enhance the releasability from the dye transfer layer 4, the adhesion between the substrate A and the dye receiving layer B is so reduced that the dye receiving layer B is easily peeled off the substrate A and transferred to the dye transfer layer 4 of the image transfer recording medium after thermal recording as illustrated in FIG. 3.

Figure 4:
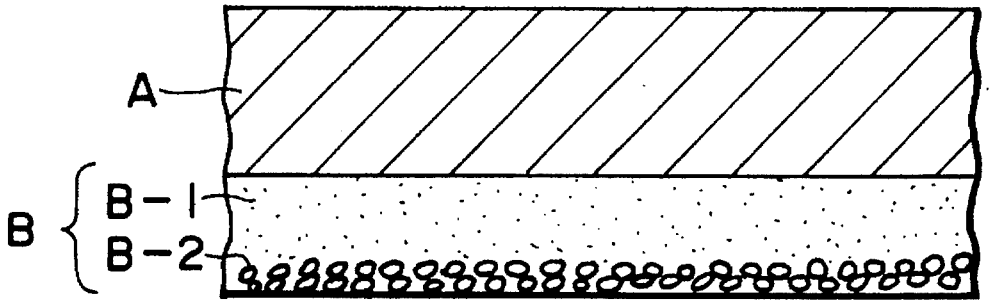
FIG. 4 is an enlarged schematical cross-sectional view of an image receiving medium according to the present invention.

In the image receiving medium according to the present invention, the first silicone oil is uniformly distributed throughout the dye receiving layer B, while the second silicone oil is present more in the vicinity of the outer surface indicated by "B-2" of the dye receiving layer B than in the inner portion indicated by "B-1" as shown in FIG. 4. Therefore, the dye receiving layer B can be smoothly released from an image transfer recording medium after thermal recording. Moreover, the amount of the silicone contained in the portion indicated by B-1 in FIG. 4 is relatively small, so that the adhesion between the substrate A and the dye receiving layer B is not reduced. The dye receiving layer B, therefore, is not peeled off the substrate A.

The effects of the first and second silicone oils will be explained in more detail.

In the case where a dye receiving layer of an image receiving medium comprises not both of the first and second silicone oils, but only the first silicone oil as a releasant, the first silicone oil exists in a relatively small amount in the vicinity of the surface B-1 of the dye receiving layer. Therefore, the dye receiving layer B can be smoothly released from a thermal image transfer recording medium when an image with a high optical density is recorded with application of a large amount of thermal energy thereto, but cannot be released when an image with a low optical density is recorded with application of a small amount of thermal energy thereto.

On the other hand, when only the second silicone oil in a relatively small amount is incorporated into a dye receiving layer as a releasant, the dye receiving layer can easily be released from a thermal image transfer recording medium even when an image with a low optical density is recorded, but cannot be smoothly released due to a significant amount of the silicone oil used when an image with a high optical density or a multi-color image is recorded.

The above problems, which are caused when the first or second silicone oil is singly incorporated into the dye receiving layer, however, can be solved by the combination use of the first and second silicone oils.

Examples of the resin which can be dyed with a heat-sublimable dye for use in the dye receiving layer in the present invention include polyester, polycarbonate, polysulfone, polystyrene, polyvinyl alcohol, polyvinyl chloride, polyvinyl acetate, a copolymer of vinyl chloride and vinyl acetate, polyamide, polyurethane and a copolymer of styrene and acrylic acid. Of these, a copolymer of vinyl chloride and vinyl acetate, and polyester are preferred.

In the present invention, a silicone oil which is soluble in a solution consisting of the above resin and a solvent is defined as the first silicone oil, which is compatible with the resin. A solution prepared by dissolving the first silicone oil in the resin solution is in a transparent state.

A silicone oil which is not soluble but dispersible in a solution consisting of the resin and a solvent is defined as the second silicone oil, which is not compatible with the resin. A mixture prepared by dispersing the second silicone oil in the resin solution is in an opaque state.

The first silicone oil and the second silicone oil are respectively selected depending on the resin and the solvent to be used in combination.

Examples of the first silicone oil include polyether-modified silione oil, alkylaralkylpolyether-modified silicone oil, epoxy-polyether-modified silicone oil, alcohol-modified silicone oil, alkyl-modified silicone oil, fluorine-modified silicone oil and methylphenyl silicone oil. These silicone oils are used either singly or in combination.

Of the above first silicone oils, polyether-modified silicone oils, in particular, those having the following formulae (I-1), (I-2) and (I-3) are preferably employed in the present invention:

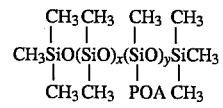

(I-1)

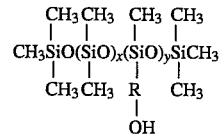

(I-2)

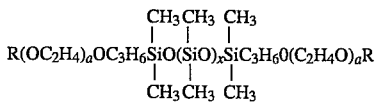

(I-3)

wherein x and y are an integer of 1 to 100, a is an integer of 1 to 50, R is an alkyl group having 1 to 4 carbon atoms, and POA is a polyoxyalkylene group.

Examples of commercially available products of the above-mentioned silicone oils are "SF8410", "SH3746", "SH3749", "SF8419", "SF8421", "SF8427", "SH230" and "FS1265" (Trademarks, all available from Toray Silicone Co., Ltd.); and "TSF 437" and "TSF 4300" (Trademarks, available from Toshiba Silicone Co., Ltd.).

Examples of the second silicone oil include amino-modified silicone oil, epoxy-modified silicone oil, carboxyl-modified silicone oil, dimethyl silicone oil and silicone diamine. These silicone oils are used either singly or in combination.

Of the above second silicone oils, amino-modified silicone oils, in particular, those having the following formulae (II-1), (II-2), (II-3) and (II-4) are preferably employed in the present invention:

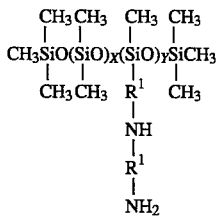

(II-1)

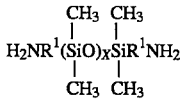

(II-2)

(II-2)

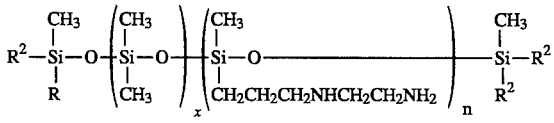

(II-4)

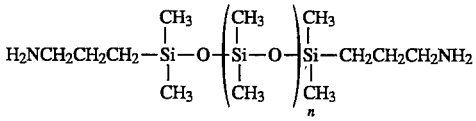

wherein $R^1$ is an alkyl group having 1 to 4 carbon atoms, $R^2$ is an alkyl group or alkoxyl group having 1 to 4 carbon atoms, x and y are an integer of 1 to 100, and n is an integer of 1 to 50.

Examples of commercial products of the above second silicone oils are "SF8417", "SF8411" and "SF8418" (Trademarks, products of Toray Silicone Co., Ltd.); "TSF451-100" (Trademark, a product of Toshiba Silicone Co., Ltd.); and "KF96 H" and "X-22-161" (Trademarks, products of Shin-Etsu Chemical Co., Ltd.).

In the present invention, the combination use of a copolymer of vinyl chloride and vinyl acetate as the resin, a polyester-modified silicone oil as the first silicone oil, an amino-modified silicone oil as the second silicone oil, and a 1:1 mixed solvent of toluene and methyl ethyl ketone as the solvent in which the former three components are dissolved is the most preferable for forming the dye receiving layer.

The incorporation amount of the first silicone oil is 1 to 20 wt. %, preferably 1 to 10 wt. %, of the weight of the resin contained in the dye receiving layer B; and the amount of the second silicone oil is 0.05 to 10 wt. %, preferably 0.1 to 5 wt. %, of the weight of the resin contained in the dye receiving layer B. Moreover, it is preferable that the amount of the first silicone oil be larger than that of the second silicone oil.

A filler may be incorporated into the dye receiving layer, if necessary. Examples of the filler include white pigments such as silica, titanium oxide and calcium carbonate. The amount of the filler is preferably 5 to 60 wt. % of the weight of the resin contained in the dye receiving layer.

Besides the filler, a surface active agent, an ultra-violet-rays-absorbing agent and an antioxidant may also be incorporated into the dye receiving layer, if necessary.

Examples of materials for the substrate A of the image receiving medium include synthetic papers such as high quality paper and cellulose fiber paper, coated papers such as art paper, gravure-coated paper and baryta paper, and plastic films. The above materials can be used either singly or in combination.

The image receiving medium of the present invention can be prepared by applying a coating liquid for forming a dye receiving layer, comprising the resin and the first and second silicone oils, on the substrate, and then dried. The amount of the coating liquid to be applied on the substrate is preferably 0.1 to 20 g/m$^2$ on a dry basis.

In order to improve the adhesion between the substrate and the dye receiving layer, an intermediate layer may be interposed therebetween, which mainly comprises a resin, or a resin and a hardening agent.

Other features of this invention will become apparent in the course of the following description of exemplary embodiments, which are given for illustration of the invention and are not intended to be limiting thereof.

Example 1

A coating liquid A for forming a dye receiving layer was prepared by thoroughly mixing the following components.

| [Coating Liquid A] | parts by weight |
|---|---|
| Vinyl chloride - vinyl acetate copolymer (Trademark "VYHH", made by Union Carbide Japan K.K.) | 100 |
| Polyether-modified silicone oil (Trademark "SH3746", made by Toray Silicone Co., Ltd.) | 8 |
| Amino-modified silicone oil (Trademark "SF8417", made by Toray Silicone Co., Ltd.) | 2 |
| Toluene | 280 |
| Methyl ethyl ketone | 280 |

The coating liquid A was coated, by using a wire bar, onto the surface of a sheet of synthetic paper, serving as a substrate, with a thickness of approximately 150 μm (Trademark "Yupo FGP-150", made by Oji-Yuka Synthetic Paper Co., Ltd.), and then dried at 90° C. for 1 minute to form a dye receiving layer with a thickness of approximately 3 μm. Thus, image receiving medium No. 1 according to the present invention was obtained.

Thermal image transfer recording media for colors of yellow, magenta and cyan were respectively prepared in the following manner:

On a substrate of a 6 μm thick polyethylene terephthalate film backed with an approximately 1 μm thick film of a silicone-hardened resin, coating liquid B having the following formulation was applied and then dried, thereby forming a yellow ink layer (dye transfer layer) with a thickness of approximately 2 μm. Thus, a thermal image transfer recording medium for yellow color was obtained.

| [Coating Liquid B] | parts by weight |
|---|---|
| Polyvinyl butyral resin (Trademark "BX-1", made by Sekisui Chemical Co., Ltd.) | 10 |
| Yellow sublimable dye (Trademark, "Foron Brilliant Yellow S-6GL", made by Bayer AG.) | 4 |
| Methyl ethyl ketone | 95 |
| Toluene | 95 |

On a substrate of a 6 μm thick polyethylene terephthalate film backed with an approximately 1 μm thick film of a silicone-hardened resin, coating liquid C having the following formulation was applied and then dried, thereby forming a magenta ink layer (dye transfer layer) with a thickness of approximately 2 μm. Thus, a thermal image transfer recording medium for magenta color was obtained.

| [Coating Liquid C] | parts by weight |
|---|---|
| Polyvinyl butyral resin (Trademark "BX-1", made by Sekisui Chemical Co., Ltd.) | 10 |
| Magenta sublimable dye (Trademark "MS Red G", made by Mitsui Toatsu Chemicals, Inc.) | 4 |
| Magenta sublimable dye (Trademark "Macrolex Red Violet R", made by Bayer AG.) | 2 |
| Methyl ethyl ketone | 95 |
| Toluene | 95 |

On a substrate of a 6 μm polyethylene terephthalate film backed with an approximately 1 μm thick film of a silicone-hardened resin, coating liquid D having the following formulation was applied and then dried, thereby forming a cyan ink layer (dye transfer layer) with a thickness of approximately 2 μm. Thus, a thermal image transfer recording medium for cyan color was obtained.

| [Coating Liquid D] | parts by weight |
|---|---|
| Polyvinyl butyral resin (Trademark "BX-1", made by Sekisui Chemical Co., Ltd.) | 10 |
| Cyan sublimable disperse dye (Trademark "Kayaset Blue 714", made by Nippon Kayaku Co., Ltd.) | 6 |
| Methyl ethyl ketone | 95 |
| Toluene | 95 |

The above-prepared image transfer recording media were subsequently superposed, in the order of yellow, magenta and cyan, on the image receiving medium with each ink layer of the image transfer recording medium being faced the dye receiving layer of the image receiving medium, with application of thermal energy to the substrate of the image transfer recording medium by a thermal head, and an image recording test was carried out by changing the energy levels. The recording density of the thermal head was 6 dots/mm, and the recording out-put power was 0.42 W/dot.

During the above test, the slipperiness of the surface of the image receiving medium was inspected. After the test, the releasability of the image receiving medium from each of the image transfer recording media for yellow, magenta and cyan was evaluated by observing whether or not the dye receiving layer had stuck to the dye transfer layer of the image transfer recording medium. The adhesion between the substrate and the dye receiving layer formed thereon was also evaluated by observing whether or not the dye receiving layer had been peeled off the substrate. The results are shown in Table 1.

Comparative Example 1

The procedure for Example 1 was repeated except that the coating liquid A used in Example 1 was replaced by coating liquid E having the following formulation, whereby comparative image receiving medium No. 1 was obtained.

| [Coating Liquid E] | parts by weight |
|---|---|
| Vinyl chloride - vinyl acetate copolymer (Trademark "VYHH", made by Union Carbide Japan K.K.) | 100 |
| Amino-modified silicone oil (Trademark "SF8417", made by Toray Silicone Co., Ltd.) | 10 |
| Toluene | 280 |
| Methyl ethyl ketone | 280 |

By using the above-prepared image receiving medium and the image transfer recording media prepared in Example 1, an image recording test was carried out in the same manner as in Example 1. The results are shown in Table 1.

Comparative Example 2

The procedure for Example 1 was repeated except that the coating liquid A used in Example 1 was replaced by coating liquid F having the following formulation, whereby comparative image receiving medium No. 2 was obtained.

| [Coating Liquid F] | parts by weight |
|---|---|
| Vinyl chloride - vinyl acetate copolymer (Trademark "VYHH", made by Union Carbide Japan K.K.) | 100 |
| Amino-modified silicone oil (Trademark "SF8417", made by Toray Silicone Co., Ltd.) | 2 |
| Toluene | 280 |
| Methyl ethyl ketone | 280 |

By using the above-prepared image receiving medium and the image transfer recording media prepared in Example 1, an image recording test was carried out in the same manner as in Example 1. The results are shown in Table 1.

Comparative Example 3

The procedure for Example 1 was repeated except that the coating liquid A used in Example 1 was replaced by coating liquid G having the following formulation, whereby comparative image receiving medium No. 3 was obtained.

| [Coating Liquid G] | parts by weight |
|---|---|
| Vinyl chloride - vinyl acetate copolymer (Trademark "VYHH", made by Union Carbide Japan K.K.) | 100 |
| Polyether-modified silicone oil (Trademark "SH3746", made by Toray Silicone Co., Ltd.) | 10 |
| Toluene | 280 |
| Methyl ethyl ketone | 280 |

By using the above-prepared image receiving medium and the image transfer recording media prepared in Example 1, an image recording test was carried out in the same manner as in Example 1. The results are shown in Table 1.

Example 2

The procedure for Example 1 was repeated except that the coating liquid A used in Example 1 was replaced by coating liquid H having the following formulation, whereby image receiving medium No. 2 according to the present invention was obtained.

| [Coating Liquid H] | parts by weight |
|---|---|
| Vinyl chloride - vinyl acetate copolymer (Trademark "VYHH", made by Union Carbide Japan K.K.) | 100 |
| Methylphenyl silicone oil (Trademark "TSF 4300", made by Toray Silicone Co., Ltd.) | 8 |
| Amino-modified silicone oil (Trademark "SF8417", made by Toray Silicone Co., Ltd.) | 2 |
| Toluene | 280 |
| Methyl ethyl ketone | 280 |

By using the above-prepared image receiving medium and the image transfer recording medium prepared in Example 1, an image recording test was carried out in the same manner as in Example 1. The results are shown in Table 1.

Example 3

The procedure for Example 1 was repeated except that the coating liquid A used in Example 1 was replaced by coating liquid I having the following formulation, whereby image receiving medium No. 3 according to the present invention was obtained.

| [Coating Liquid I] | parts by weight |
|---|---|
| Polyester resin (Trademark "Vylon 200", made by Toyobo Co., Ltd.) | 100 |
| Polyether-modified silicone oil (Trademark "SH3746", made by Toray Silicone Co., Ltd.) | 8 |
| Dimethyl silicone oil (Trademark "TSF451-100", made by Toshiba Silicone Co., Ltd.) | 2 |
| Toluene | 280 |
| Methyl ethyl ketone | 280 |

By using the above-prepared image receiving medium and the image transfer recording media prepared in Example 1, an image recording test was carried out in the same manner as in Example 1. The results are shown in Table 1.

TABLE 1

| Image Receiving | Releasability | | | | |
|---|---|---|---|---|---|
| Medium | Yellow | Magenta | Cyan | Adhesion | Slipperiness |
| No. 1 | ○ | ○ | ○ | ○ | ○ |
| No. 2 | ○ | ○ | ○ | ○ | ○ |
| No. 3 | ○ | ○ | ○ | ○ | ○ |
| Comp. No. 1 | ○ | ○ | (i) | X | X |
| Comp. No. 2 | ○ | (ii) | — | ○ | ○ |
| Comp. No. 3 | (iii) | — | — | ○ | ○ |

Note)
In the item of "Releasability",
"○": The image receiving medium was completely released from the image transfer recording medium;

TABLE 1-continued

| Image Receiving | Releasability | | | | |
|---|---|---|---|---|---|
| Medium | Yellow | Magenta | Cyan | Adhesion | Slipperiness |

(i): The image receiving medium was entirely transferred to the transfer image recording medium;
(ii): The image receiving medium was fused and stuck to the image transfer recording medium only at the portion which was consumed for yielding an image with a high optical density;
(iii): The image receiving medium was fused and stuck to the image transfer recording medium only at the portion which was consumed for yielding an image with a low optical density; and
"—": No further image transfer was possible.
In the item of "Adhesion",
"○": The dye receiving layer did not peel off the substrate, and
"X": The dye receiving layer peeled off the substrate.
In the item of "Slipperiness",
"○": The slipperiness of the surface of the image receiving medium was moderate, and
"X": The slipperiness of the surface of the image receiving medium was excessively high.

What is claimed is:

1. An image receiving medium for use in a sublimation thermal image transfer recording system, comprising a substrate, and a dye receiving layer formed thereon, comprising:

(a) a resin which can be dyed with a heat-sublimable dye, (b) a first silicone oil which is compatible with said resin, and (c) a second silicone oil which is not compatible with said resin.

2. The image receiving medium as claimed in claim 1, wherein the amount of said first silicone oil is in the range of 1 wt. % to 20 wt. % of the weight of said resin, and the amount of said second silicone oil is in the range of 0.05 wt. % to 10 wt. % of the weight of said resin.

3. The image receiving medium as claimed in claim 1, wherein said first silicone oil is uniformly distributed throughout said dye receiving layer and said second silicone oil is present more in the vicinity of the outer surface of said dye receiving layer than in the inner portion of said dye receiving layer near said substrate.

4. The image receiving medium as claimed in claim 3, wherein the amount of said first silicone oil is in the range of 1 wt. % to 20 wt. % of the weight of said resin, and the amount of said second silicone oil is in the range of 0.05 wt. % to 10 wt. % of the weight of said resin.

5. The image receiving medium as claimed in claim 1, wherein said resin is selected from the group consisting of polyester, polycarbonate, polysulfone, polystyrene, polyvinyl alcohol, polyvinyl chloride, polyvinyl acetate, a copolymer of vinyl chloride and vinyl acetate, polyamide, polyurethane and a copolymer of styrene and acrylic acid.

6. The image receiving medium as claimed in claim 1, wherein said first silicone oil is a silicone oil or a mixture of silicone oils selected from the group consisting of polyether-modified silione oil, alkylaralkylpolyether-modified silicone oil, epoxy-polyether-modified silicone oil, alcohol-modified silicone oil, alkyl-modified silicone oil, fluorine-modified silicone oil and methylphenyl silicone oil.

7. The image receiving medium as claimed in claim 6, wherein said first silicone oil is a polyester-modified silicone oil.

8. The image receiving medium as claimed in claim 1, wherein said second silicone oil is a silicone oil or a mixture of silicone oils selected from the group consisting of amino-modified silicone oil, epoxy-modified silicone oil, carboxyl-modified silicone oil, dimethyl silicone oil and silicone diamine.

9. The image receiving medium as claimed in claim 8, wherein said second silicone oil is an amino-modified silicone oil.

10. The image receiving medium as claimed in claim 1, further comprising an intermediate layer interposed between said substrate and said dye receiving layer.

* * * * *